US008783004B2

(12) United States Patent
Beck

(10) Patent No.: US 8,783,004 B2
(45) Date of Patent: Jul. 22, 2014

(54) DEVICE FOR FILLING AND COMPACTING POURABLE PRODUCTS

(75) Inventor: Martin Beck, Pluederhausen (DE)

(73) Assignee: Robert Bosch GmbH, Stuttgart (DE)

( * ) Notice: Subject to any disclaimer, the term of this patent is extended or adjusted under 35 U.S.C. 154(b) by 502 days.

(21) Appl. No.: 13/140,273

(22) PCT Filed: Nov. 3, 2009

(86) PCT No.: PCT/EP2009/064493

§ 371 (c)(1),
(2), (4) Date: Jun. 16, 2011

(87) PCT Pub. No.: WO2010/069665

PCT Pub. Date: Jun. 24, 2010

(65) Prior Publication Data

US 2011/0247307 A1 Oct. 13, 2011

(30) Foreign Application Priority Data

Dec. 18, 2008 (DE) ..... 10 2008 054 922

(51) Int. Cl.
*B65B 1/24* (2006.01)
*B65B 39/00* (2006.01)

(52) U.S. Cl.
CPC *B65B 1/24* (2013.01); *B65B 39/007* (2013.01)
USPC ..... 53/527; 53/436

(58) Field of Classification Search
CPC ..... B65B 63/02; B65B 1/24; B65B 1/32; B65B 27/125; B65B 61/24; B65B 39/007; B65D 85/16; A22C 7/00; B30B 11/005; B30B 15/0094
USPC ..... 53/436, 439, 527
See application file for complete search history.

(56) References Cited

U.S. PATENT DOCUMENTS

| | | | | | |
|---|---|---|---|---|---|
| 2,046,366 | A | * | 7/1936 | Collins | 206/63.5 |
| 2,423,358 | A | * | 7/1947 | Hohl et al. | 53/432 |
| 2,464,099 | A | * | 3/1949 | Norman | 53/208 |
| 3,040,882 | A | * | 6/1962 | Van Beckum et al. | 206/83.5 |
| 3,405,744 | A | * | 10/1968 | Bowman | 141/12 |
| 3,748,819 | A | * | 7/1973 | Christensson | 53/527 |
| 4,018,030 | A | * | 4/1977 | Christensson | 53/527 |
| 4,154,045 | A | | 5/1979 | Christensson | |
| 4,273,789 | A | * | 6/1981 | Zimmerman | 426/231 |

(Continued)

FOREIGN PATENT DOCUMENTS

| | | |
|---|---|---|
| CN | 101315820 | 12/2008 |
| DE | 4219240 A1 | 12/1993 |

(Continued)

OTHER PUBLICATIONS

PCT/EP2009/064493 International Search Report.

*Primary Examiner* — Hemant M Desai
(74) *Attorney, Agent, or Firm* — Michael Best & Friedrich LLP

(57) ABSTRACT

A device for filling and compacting pourable products is proposed, comprising: —at least one product feed (16) for feeding a pourable product to a container (12) that is to be filled, —at least one ram (14) for compacting the product supplied to the container (10), characterized by means for applying a predetermined force to the ram (14) and for detecting the force acting on the ram.

16 Claims, 2 Drawing Sheets

(56) References Cited

U.S. PATENT DOCUMENTS

| | | | | | |
|---|---|---|---|---|---|
| 4,768,260 | A | * | 9/1988 | Sandberg | 425/556 |
| 4,804,550 | A | * | 2/1989 | Bardsley et al. | 426/397 |
| 4,864,803 | A | * | 9/1989 | Bohrmann | 53/527 |
| 4,962,627 | A | * | 10/1990 | Gueret | 53/412 |
| 5,087,398 | A | * | 2/1992 | Le Molaire et al. | 264/40.5 |
| 5,201,164 | A | * | 4/1993 | Kaufman | 53/436 |
| 5,202,067 | A | * | 4/1993 | Solazzi et al. | 264/40.5 |
| 5,361,692 | A | * | 11/1994 | Zimmer | 100/229 A |
| 5,406,990 | A | * | 4/1995 | Haeberli | 141/12 |
| 5,433,903 | A | * | 7/1995 | Hauser et al. | 264/37.1 |
| 5,906,837 | A | * | 5/1999 | Link et al. | 425/78 |
| 6,055,793 | A | * | 5/2000 | Irwin et al. | 53/436 |
| 6,325,609 | B1 | * | 12/2001 | Shimada | 425/140 |
| 6,382,945 | B1 | * | 5/2002 | Chen et al. | 425/116 |
| 6,397,635 | B1 | * | 6/2002 | Sasso et al. | 65/160 |
| 2008/0145466 | A1 | | 6/2008 | Beane | |
| 2009/0188160 | A1 | * | 7/2009 | Liu et al. | 44/535 |
| 2009/0267253 | A1 | * | 10/2009 | Fitzpatrick | 264/40.3 |

FOREIGN PATENT DOCUMENTS

| | | | |
|---|---|---|---|
| DE | 19718455 | A1 | 11/1997 |
| DE | 102006010092 | A1 | 9/2007 |
| GB | 1412688 | | 11/1975 |

* cited by examiner

DEVICE FOR FILLING AND COMPACTING POURABLE PRODUCTS

This patent application is a U.S. National Phase of International Patent Application No. PCT/EP09/64493, filed 3 Nov., 2009, which claims priority to German Patent Application No. 10 2008 054 922.3, filed 18 Dec., 2008, the disclosures of which are incorporated herein by reference in their entirety.

BACKGROUND OF THE INVENTION

The invention proceeds from a device for filling and compacting pourable products. DE 10 2006 010 092 A1 has already made known a device for filling with a fine-grained product. In this case a metering device, a guiding device for supplying the product from the metering device into a packaging unit and a suction device for sucking in swirled up, fine-grained product are provided with a suction housing, the guiding device being guided through the suction housing and the guiding device and the suction housing being located above the packaging unit.

SUMMARY OF THE INVENTION

The object underlying the invention is to improve the filling operation further.

The advantage of the device as claimed in the invention for filling and compacting pourable products in contrast is that the filling operation is improved further by providing a force-regulated filling and compacting of pourable products. In particular in the case of certain products such as, for example, coffee powder, force-controlled pressing is particularly advantageous in order to obtain a certain taste. In addition, the device is distinguished by a particularly space-saving arrangement, as it is possible to effect filling and pressing in just one operating station.

In an expedient further development, it is provided that a linear drive and/or a pneumatic cylinder are/is provided as means for applying a force to the plunger. The former is distinguished by simple controllability. For applying a pressing force, it is additionally possible for an application of force by the linear drive to overlie the pneumatic cylinder. This means, in particular, that small linear drives can be used which then take over the force-controlled or force-regulated impingement of the plunger. A minimum contact force is preferably applied to the plunger by means of the pneumatic cylinder.

In an expedient further development, it is provided that the linear drive acts on the plunger by way of a lever mechanism. This arrangement is distinguished, on the one hand, by a particularly small installation space requirement. In addition, a corresponding leverage allows for the use of relatively small linear motors for controlling or regulating the force of the contact force of the plunger.

In an expedient further development, detecting means are provided for detecting the force acting on the plunger. Load cells are particularly suitable for this on account of their sturdy design. The measuring data of the detecting means can be used for controlling the required value of the linear motor. This means that the achieving of the pre-selected pressing force is ensured in a particularly simple manner.

In an expedient further development, the detecting means is located directly above the plunger. This means that friction losses in the guides and lever mechanisms located above the detecting means are not important. This means that the products of the force-controlling or force-regulating process are improved further.

In an expedient further development, it is provided that stripping means are provided that prevent the product to be compacted from sticking to the underside of the plunger. Mechanisms that force the plunger to move rotationally about the longitudinal axis, or also ultrasound devices that can cause the plunger to vibrate, are particularly suitable in this case. This means that the sticking of the product to be filled is avoided, thereby presenting a constantly high quality of the force-controlled pressing or compacting of the product.

In an expedient further development, it is provided that at least two plungers are located so as to be displaceable together with the means for applying a force, in relation to a filling unit, above which the product to be filled is supplied to the receptacle to be filled. This means that it can be achieved in a particularly preferred manner that a plurality of plungers can also be moved to compact the filled product by way of only one movement mechanism, whilst, on the other hand, it can be ensured that each plunger can be displaced individually in a force-regulated or force-controlled manner. This contributes additionally to the minimizing of the space required for the overall arrangement with constantly high filling quality on account of the plungers that can be separately force-controlled or force-regulated.

Additional expedient further developments are produced from the description.

BRIEF DESCRIPTION OF THE DRAWINGS

An exemplary embodiment of the device according to the invention for filling and compacting pourable products is represented in the drawing and is described below in more detail, in which.

DETAILED DESCRIPTION

Figure 1:
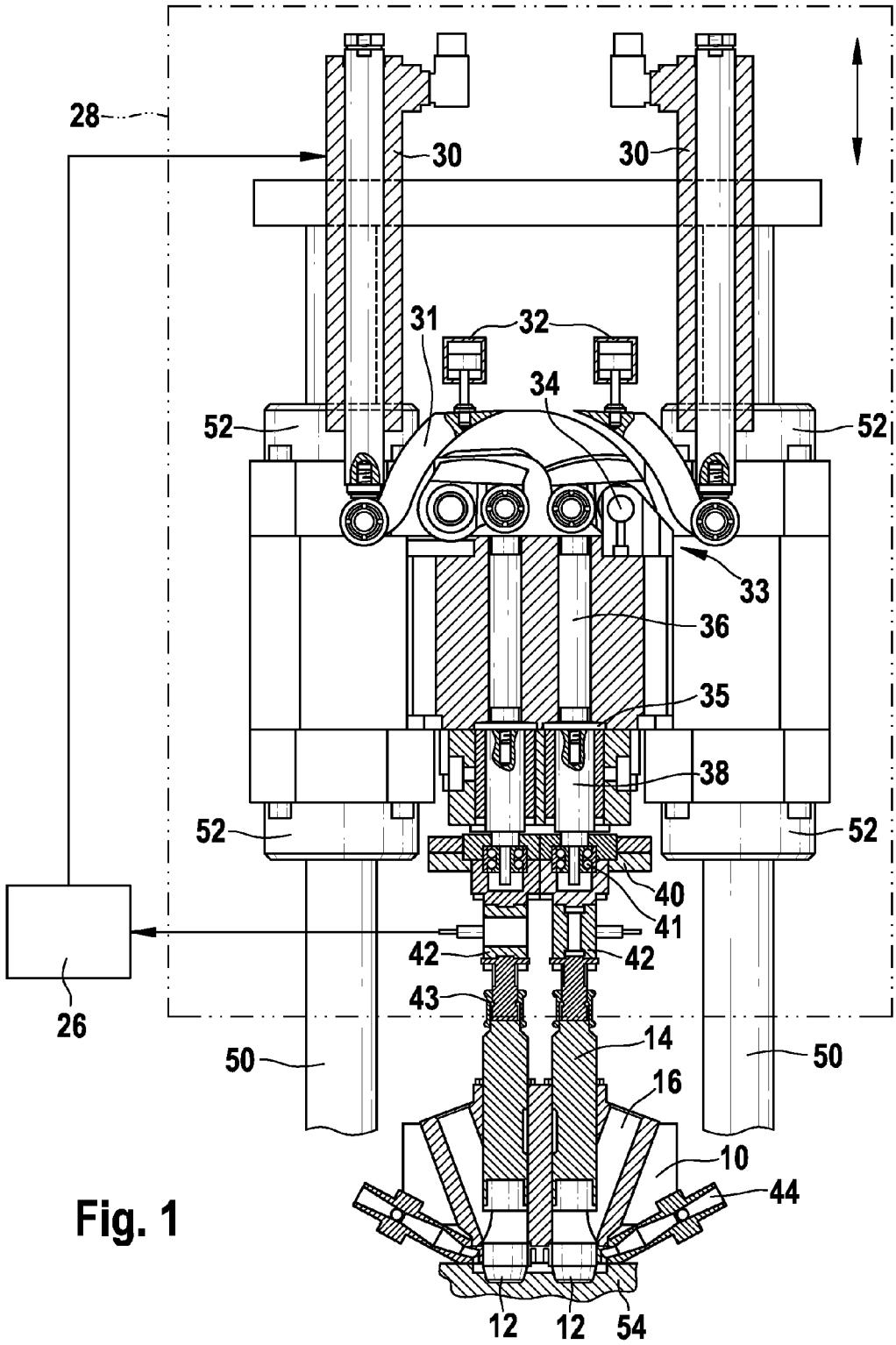
FIG. 1 shows a partial longitudinal sectional view of the device.
Figure 2:
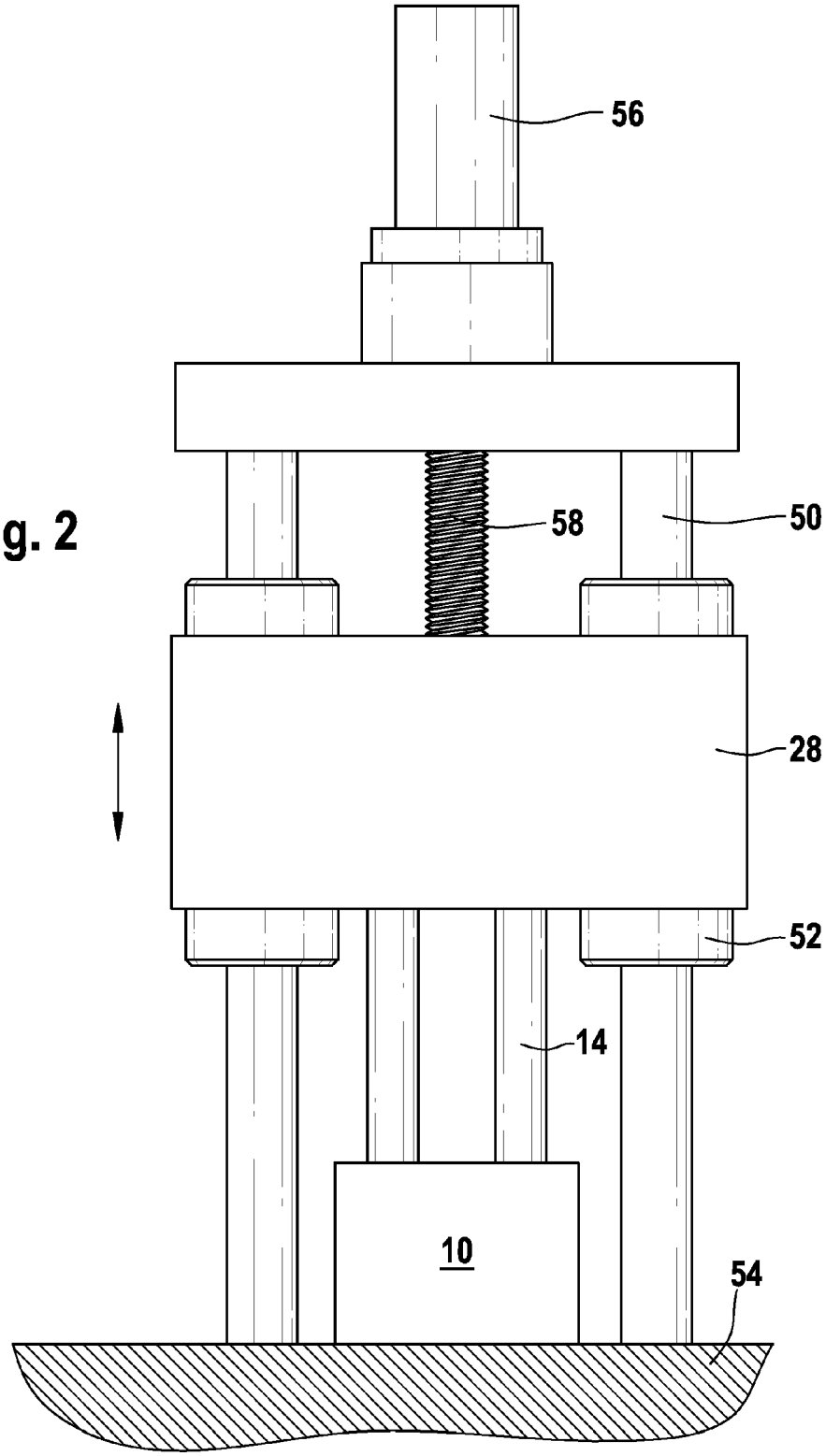
FIG. 2 shows a schematic view of a displaceable plunger unit.

As an example, two receptacles 12 are filled in this case with a pourable product via a fill block 10. The pourable product passes into the receptacle 12 via a product feed 16, which is located in an inclined manner opposite a longitudinal axis of a plunger 14. Between the mouth of the product feed 16 and of the receptacle 12 there is located an opening of an ejector 44 that is preferably realized as an annular suction means in order to minimize possible product losses. A plunger unit 28 is located so as to be moveable in relation to the fill block 10, which is what the double arrow at the side is to represent. To this end, the displaceable plunger unit 28 includes a plurality of guide bushes 52 which ensure a displaceability of the plunger unit 28 in relation to fixed guide rods 50. The plunger unit 28 includes at its bottom end, shown as an example, two plungers 14 that are each connected to a pressure detecting means 42 via corresponding sleeves 43. Plunger 14, sleeve 43 and load cell 42 are rotatably mounted via a bearing arrangement 41 and can be rotated about the central axis of the plunger by a rotating device 40 located within the bearing region. An output signal of the pressure detecting means 42 is supplied to a drive device 26, which in turn generates a drive signal for a linear motor 30. The linear motor 30 is a structural component of the plunger unit 28. A movement of the linear motor 30 acts on a lever arm 31 that is rotatably mounted by means of a bearing point 34 of a bearing block 33. A corresponding movement of the linear drive 30, where applicable amplified by a pneumatic cylinder 32 also acting on the lever arm 31, pushes in a pressure rod 36 that is arranged coaxially to the plunger 14. The movement of the pressure rod 36 and consequently of the plunger 14 is defined by a stop member 35. A guide 38 transmits the movement of the pressure rod 36 to the plunger 14.

The displaceability of the plunger unit 28 in relation to the fill block 10 is achieved in that parallel to the direction of displacement of the plungers 14, guide rods 50 are connected to a machine frame 54. The fill block 10 also rests on the machine frame 54. The guide rods 50 can be interconnected at the top via a frame on which a motor 56 rests. The latter activates a spindle 58, via which the plunger unit 28 with associated plungers 14 can be displaced along the guide rods 50, mounted in the guide bushes 52.

High-quality products demand force-controlled pressing to obtain, for example in the case of coffee powder, a certain taste. In order to achieve as high an output as possible in the case of corresponding filling systems, it is necessary to construct in a small space. A cost-efficient way in which to produce receptacles 12 is the thermoforming of plastic films. To generate as little waste as possible, attempts are also made with these systems to arrange the receptacles 12 as close to each other as possible. The device for filling and compacting pourable products can be used, for example, on a thermoforming machine in order to achieve, once the receptacle 12 has been filled, in the smallest space a force-controlled or force-regulated pressing of the product in one station or in one single operation.

To this end, the receptacle 12 is raised to the mouth of the fill block 10. The product is metered into the receptacle 12 through the product feed 16, which is realized as a bore. The metering amount, in this case, can exceed the receptacle volume as the receptacle 12 abuts closely against the mouth of the fill block 10. Once the metering has been completed, the plunger 14 is moved downward to compress the product located in the receptacle 12.

During or after the pressing operation, the plunger 14 is rotated by means of the rotating device 40 to avoid the product sticking to the plunger 14. The rotating device 40 is preferably designed as a rack and pinion drive. It would also be possible to use other techniques for this, for example causing the plunger 14 to vibrate. This could be effected by means of ultrasound.

In order to move the plunger 14 in relation to the receptacle 12 for pressing, the entire plunger unit 28 is displaced in relation to the fixed fill block 10. To this end, the plunger unit 28 is displaced by the motor 56 downward or upward along the guide rods 50 via the spindle 58. The plunger unit 28 is mounted by means of guide bushes 52 in relation to the guide rods 50. The guide rods 52 can be components of the machine frame 54.

The plunger 14 is guided in the plunger unit 28 itself in an axially torque-secured manner. This task is taken over by the guide 38 that is preferably realized as a torque bushing. This ensures that the rotation of the plunger 14 does not go further upwards beyond the guide 38.

The actual pressing force is introduced by the lever 31 which has its fulcrum 34 in the bearing block 33. To this end, a linear motor 30 and a pneumatic cylinder 32 press on the lever 31, which exerts a force via a roller onto a pressure rod 36 and the guide 38. The stop member 35 prevents a more extensive movement. If the plunger 14 then contacts the product, presses it and exceeds the force preselected in the linear motor 30, the plunger 14 quasi spring deflects in its guide. At the same time the linear motor 30 regulates the force presented and consequently ensures the selected pressing force. In order to generate a relatively high pressing force, on the one hand the lever arm 31 is used. In addition, the pneumatic cylinder 32 also supports the application of a force. By selecting a corresponding pressure beforehand and through corresponding leverage, relatively small linear motors 30 can also be used. Types of drive other than linear motors 30 are also suitable for this. They just have to displace the lever arm 31 such that the desired pressing force is presented to the plunger 14.

The pressure detecting means 42 is used to monitor the pressing force. Said means detects the pressing force applied to the plunger 14 and provides a corresponding output signal to the drive device 26. Measuring data of the pressure detecting means 42 can be used to control the required value of the linear motor 30. This means that achieving the preselected pressing force is ensured. A pressure force sensor 42 that is designed, for example, as a load cell is preferably used as pressure detecting means. The direct arrangement above the plunger 14 means that friction losses in the guides 38 and in corresponding force transmission mechanisms 31, 33, 34, 36 are not important. The measuring results are, consequently, not falsified.

Possible product losses through gaps between receptacle 12 and mouth of the product feed 16 are sucked out through an annular suction of the ejector 44.

The plunger unit 28 includes in a particularly preferred manner at least two plungers 14. For the pressing process, the at least two plungers 14 can be displaced by just one movement device 56, 58. On the other hand, it is ensured that a separate drive device 30 for controlling the pressing force or for regulating the pressing force is associated with each plunger 14. Consequently, it is possible to adapt the pressing force of each plunger 14 individually. Over and above this, to obtain a particularly space-saving design of the plunger unit 28, the respective lever arms 31 for the respective plungers 14 are located one behind another and interlock.

The invention claimed is:

1. A device for filling and compacting pourable products, said device comprising:

at least one product feed (16) for supplying a pourable product to a receptacle (12) to be filled, at least two plungers (14) for compacting the product supplied to the receptacle (12), means (30, 32) for applying a predetermined force to the plungers (14), characterized in that a displacement mechanism (56, 58) is provided that displaces the at least two plungers together for compacting, and that a force of the at least two plungers (14) is respectively controlled or regulated separately from each other.

2. The device as claimed in claim 1, characterized in that detecting means (42) are provided for detecting the force acting on the plunger (14).

3. The device as claimed in claim 1, characterized in that at least one drive means (26) is provided for driving the means (30, 32) for applying a predetermined force.

4. The device as claimed in claim 1, characterized in that the drive means (26) generates a drive signal for at least one of the means (30) for applying a predetermined force, in dependence on an output signal of the detecting means (42).

5. The device as claimed in claim 1, characterized in that the drive means (26), in dependence on the output signal of the detecting means (42), adapts a required value for the driving of the means (30) for applying a predetermined force.

6. The device as claimed in claim 1, characterized in that at least one linear drive (30) is provided as the means for applying a predetermined force.

7. The device as claimed in claim 1, characterized in that the means (30, 32) for applying a predetermined force act on the plunger (14) via at least one lever arm (31).

8. The device as claimed in claim 7, characterized in that the lever arm (31) is connected to the plunger (14) by means of at least one pressing rod (36).

9. The device as claimed in claim 7, characterized in that the lever arm (31) is connected to the plunger (14) by means of a guide (38).

10. The device as claimed in claim 9, characterized in that the lever arm (31) is also connected to the plunger (14) by means of at least one pressing rod (36).

11. The device as claimed in claim 7, characterized in that the lever arm (31) is connected to the plunger (14) by means of a straight guide with a locking element.

12. The device as claimed in claim 1, characterized in that at least one stop member (35) is provided for defining a displacement path of a stroke of the plunger (14).

13. The device as claimed in claim 1, characterized in that means (40) are provided that prevent the product to be filled from sticking to the plunger (14).

14. The device as claimed in claim 1, characterized in that the detecting means (42) is located directly above the plunger (14).

15. The device as claimed in claim 1, characterized in that a pneumatic cylinder (32) is provided as the means for applying a predetermined force.

16. The device as claimed in claim 15, characterized in that at least one linear drive (30) is also provided as the means for applying a predetermined force.

* * * * *